US006401358B1

(12) United States Patent
Bär et al.

(10) Patent No.: US 6,401,358 B1
(45) Date of Patent: Jun. 11, 2002

(54) METHOD AND DEVICE FOR DRYING A RAPIDLY CONVEYED PRODUCT TO BE DRIED, ESPECIALLY FOR DRYING PRINTING INK

(75) Inventors: Kai K. O. Bär; Rainer Gaus, both of Bruckmühl-Heufeld (DE)

(73) Assignee: Advanced Photonics Technologies AG (DE)

( * ) Notice: Subject to any disclaimer, the term of this patent is extended or adjusted under 35 U.S.C. 154(b) by 0 days.

(21) Appl. No.: 09/622,599

(22) PCT Filed: Feb. 18, 1999

(86) PCT No.: PCT/EP99/01057

§ 371 (c)(1),
(2), (4) Date: Oct. 13, 2000

(87) PCT Pub. No.: WO99/42774

PCT Pub. Date: Aug. 26, 1999

(30) Foreign Application Priority Data

Feb. 23, 1998 (DE) ..... 198 07 643

(51) Int. Cl.[7] ..... F26B 3/00; F26B 13/10

(52) U.S. Cl. ..... 34/266; 34/267; 34/269; 34/273; 34/420; 34/446; 34/611; 34/575

(58) Field of Search ..... 34/266, 267, 268, 34/269, 273, 446, 445, 459, 463, 465, 549, 552, 611, 575, 624, 420, 421, 422

(56) References Cited

U.S. PATENT DOCUMENTS

| | | | | | |
|---|---|---|---|---|---|
| 2,627,667 | A | * | 2/1953 | Gillis | 34/23 |
| 2,874,482 | A | * | 2/1959 | Haltmeier | 34/31 |
| 3,238,635 | A | * | 3/1966 | Gravenstreter | 34/23 |
| 4,494,316 | A | * | 1/1985 | Stephansen et al. | 34/68 |
| 4,756,091 | A | * | 7/1988 | Van Denend | 34/4 |
| 5,261,165 | A | * | 11/1993 | Tate | 34/1 W |
| 5,261,166 | A | * | 11/1993 | Seeley et al. | 34/1 X |
| 5,440,821 | A | * | 8/1995 | Hamrin | 34/267 |
| 5,537,925 | A | * | 7/1996 | Secor et al. | 101/424.1 |
| 5,937,535 | A | * | 8/1999 | Hoffman et al. | 34/78 |
| 5,966,836 | A | * | 10/1999 | Valdez et al. | 34/448 |
| 6,067,726 | A | * | 5/2000 | Rogne et al. | 34/268 |

* cited by examiner

*Primary Examiner*—Ira S. Lazarus
*Assistant Examiner*—K. B. Rinehart
(74) *Attorney, Agent, or Firm*—Marshall, Gerstein & Borun

(57) ABSTRACT

A method and an apparatus for drying a substance that is being rapidly conveyed in a conveyor apparatus, in particular for drying layers of printing ink on rapidly transported paper, wherein in a drying zone by means of incident electromagnetic radiation a moisture component, in particular a solvent, is separated from the substance to be dried. The separated moisture component is transported away from the drying zone by means of a transport gas current. Efficient and rapid drying of in particular printed newsprint or thermal printing paper is attained at high conveyor velocities.

21 Claims, 1 Drawing Sheet

METHOD AND DEVICE FOR DRYING A RAPIDLY CONVEYED PRODUCT TO BE DRIED, ESPECIALLY FOR DRYING PRINTING INK

BACKGROUND OF THE INVENTION

The invention relates to a method and an apparatus for drying a substance that is being rapidly transported in a conveyor apparatus, in particular for drying layers of printing ink on rapidly conveyed paper. The invention relates in particular to rapidly conveyed paper with a transport velocity between 2 and 25 m/s.

When a rapidly conveyed substance is to be dried, it is extremely important that the drying operation take effect quickly. For example, the direction of movement of the material carrying a substance to be dried is changed by passage over several deflecting rollers, at a given one of which either one side or the other of the carrier material may make contact with the roller. If, for instance, in an apparatus for printing paper a layer of ink is applied to the paper and then the printed paper passes around a deflecting roller with its printed surface touching the roller, the layer of ink must be sufficiently dry before the paper reaches the roller. For other steps of the process subsequent to printing, as well, adequately dry ink is a prerequisite. Examples include the stacking of printed single pages, one over another, or the rolling up of a printed strip of paper. A similar situation is encountered in the manufacture of paper, when strips of paper that are wet throughout are rapidly conveyed for further processing.

The object of the invention is to disclose a method and an apparatus of the kind mentioned above with which drying of the substance to be dried can be accomplished quickly.

SUMMARY OF THE INVENTION

The method in accordance with the invention for drying an substance that is being rapidly conveyed in a conveyor direction, in particular for drying layers of printing ink on rapidly conveyed paper, electromagnetic radiation is directed into a drying zone so as to separate a moisture component, in particular a solvent, from the substance to be dried and the separated moisture component is transported out of the drying zone by a transport gas current. Electromagnetic radiation, in particular infrared radiation, has proved especially useful and efficient for drying. Even when the carrier material is being conveyed at high velocities, only one drying zone is needed, the length of which is short in the conveyor direction.

During separation of the moisture component from the substance to be dried, the separated moisture component can form a boundary layer that covers the substance and prevents further drying. In particular, a dynamic equilibrium becomes established at the surface of the substance to be dried, in which approximately as many moisture particles emerge from the substance as re-enter it from the boundary layer. In accordance with the invention, therefore, the separated moisture component is removed from the drying zone by a transport gas current. In particular when the transport gas is introduced continuously into the drying zone, the production of a boundary layer that would hinder drying is prevented, because the particles of the separated moisture component are transported away only a short time after they have emerged from the substance to be dried.

The electromagnetic radiation is preferably adjusted to the absorption properties of the moisture component in such a way that the radiation energy is substantially absorbed only by the moisture component and not by the remaining components of the substance to be dried and/or by a carrier material that is not moist. As a result, the moisture component is not vaporized in the strict sense, but instead the particles of the moisture component are specifically activated and expelled from the substance to be dried.

Preferably the transport gas current (D) flows into the drying zone through a region oriented transverse to the conveyor direction, from a direction that encloses an angle of 60 to 90°, preferably about 80°, with the perpendicular to the surface of the substance to be dried, thus striking the substance like a knife. As a result, the transport gas can carry along the moisture particles that emerge from the substance without transferring a substantial fraction of its kinetic energy to the substance. A mechanical deformation of the substance to be dried, which for example could cause blurring of the sharp edges of an ink imprint, is thus avoided.

Preferably the transport gas current exerts a close-range action in the region where it flows into the drying zone, inasmuch as it strikes the surface of the substance to be dried directly, so that a surface layer formed by the separated moisture component is raised away from the substance as though sliced by a knife. The sharp angle of incidence, in particular, enhances this knife-like action.

In particular the combination of the close-range effect with the orientation of the region within which the transport gas current flows into the drying zone, namely elongated in the direction perpendicular to the conveyor direction, results in an advantageously rapid drying effect over the entire extent of the region. It is also advantageous that the velocity of the transport gas current is the same over the entire width of the region occupied by the substance to be dried.

It is favourable for the transport gas current to flow along the surface of the substance to be dried either in the same direction as the substance is being conveyed or in the opposite direction, for a certain distance. This distance can in particular be longer than the length of the drying zone within which the electromagnetic radiation is incident on the substance. Thus it is ensured that the moisture particles will be transported away over the entire drying zone and even beyond it.

So as to cool the substance to be dried, if it is warmed by the electromagnetic radiation, the temperature of the transport gas current is lower, at least before it strikes the moisture component, than the temperature of the substance to be dried. This is advantageous in particular in the case of a heat-sensitive carrier material, because by the cooling of the substance to be dried, heat transfer from the substance to the carrier material can be reduced or prevented.

It is useful for the transport gas current to be formed of expanded pressurized air.

In particular if the moisture component of the substance to be dried is water, the incident electromagnetic radiation has a spectral intensity maximum in the near infrared, in particular in the wavelength range 0.8 to 2.0 $\mu$m. As a result a substantial proportion of the radiation energy is introduced into the substance specifically as excitation energy for particles of the moisture component, in particular water. In the specified wavelength range there are several absorption bands of water. However, other moisture components, in particular solvents, also have absorption bands in this wavelength range.

For reasons of efficiency of the relevant thermodynamic processes, in particular to raise the overall efficacy when the method in accordance with the invention is employed, after leaving the drying zone the transport gas current flows to the source of the electromagnetic radiation in order to cool this source. In particular when the latter takes the form of a thermal radiator operated at a temperature above 2500 K, cooling is required. When the transport gas current is used in this way, it is possible either to do without another, supplementary form of cooling or such supplementary cooling means can have correspondingly smaller dimensions.

To ensure that specified temperature conditions are maintained, the temperature of the dried substance and/or the temperature of the separated moisture component and/or the temperature of the carrier material is regulated by adjusting the radiation flux density of the electromagnetic radiation incident in the drying zone according to a further development of the method. Preferably the temperature to be regulated is measured by means of a pyrometer.

It is useful to use as radiation source for the electromagnetic radiation an electric incandescent bulb, in particular a halogen bulb, and to adjust the radiation flux density by adjusting the current supply to the incandescent filament. In addition or alternatively, to adjust the radiation flux density the distance of the radiation source from the drying zone can be adjusted.

The drying is particularly efficient in a further development of the method in which components of the electromagnetic radiation that are not absorbed and thus pass through the substance to be dried are reflected back onto the substance. There the reflected radiation components are at least partially absorbed, so that the total amount of radiation absorbed is increased. Hence the radiation source employed, or the plurality of such sources, can have smaller dimensions with respect to its radiation output, or it can irradiate a larger drying zone. It is also possible to use reflected radiation components to irradiate zones along the conveyor path of the carrier material onto which no radiation that comes directly from the radiation source or sources is incident. Preferably a reflector used for reflection of the non-absorbed radiation components is cooled, in particular to minimize the emission of longer-wavelength infrared radiation.

The method in accordance with the invention can be especially advantageously employed when the carrier material is paper being conveyed at a velocity between 2 and 25 m/s. In a particular embodiment, the paper is either newsprint conveyed at a velocity between 10 and 20 m/s, in particular at about 15 m/s, or else thermoprinting paper conveyed at a velocity between 2 and 10 m/s, in particular at about 5 m/s.

In particular when thermoprinting paper is used as carrier material, the temperature of the carrier material is adjusted and/or regulated to a value below 70° C., in particular below 50° C. By this means an undesired thermally induced change in the carrier material or its properties can be avoided.

Preferably the transport gas current strikes the particles of the moisture component that are to be removed with a velocity between 20 and 120 m/s, and carries these particles along. In particular, the current velocity when it strikes the substance to be dried is between 30 and 40 m/s. By using a sufficiently high transport-gas velocity, for example in the specified ranges, a layer of moisture particles that have been separated from the substance to be dried, which would interfere with drying, is reliably broken up and/or lifted away from the surface of the substance, or else is never formed at all, at least not directly at the surface of the substance. In comparison with trials in which the transport gas current in accordance with the invention was omitted, drying rates 70 to 80% higher have been observed when this feature was employed.

The apparatus in accordance with the invention for drying an substance that is being conveyed rapidly in a conveyor direction, in particular for drying layers of printing ink on rapidly conveyed paper, comprises the following:

- a radiation source to generate electromagnetic radiation, the radiation source being so arranged that at least part of the electromagnetic radiation is incident on the substance to be dried in a drying zone along the conveyor path of the carrier material, in order to separate from the substance a moisture component, in particular a solvent,
- a transport-gas supply through which transport gas is introduced and
- a transport-gas conduit that at least in parts extends transverse to the conveyor direction and is so constructed and disposed that the supplied transport gas is guided into the drying zone and strikes the substance to be dried like a knife, in order to transport the separated moisture component away from the substance to be dried.

Advantages of the apparatus in accordance with the invention have been cited above.

In particular, the transport-gas supply is a compressed-air supply and the transport-gas conduit comprises a compressed-air distributor that extends transverse to the conveyor path, in particular a distributor pipe, to distribute the compressed air flowing in from the gas inlet substantially over the entire width of the conveyor path. Preferably a single compressed-air supply, when so connected, suffices to introduce compressed air that serves to remove the moisture component from the substance to be dried over the entire width of the conveyor path.

Preferably the transport-gas conduit comprises a guide surface that runs approximately along the conveyor path of the substance to be dried and is separated therefrom by a distance that progressively diminishes in the direction of gas flow. The guide surface ends at a gas-passage gap defined by the guide surface itself and the surface of the substance to be dried. The gas enters the drying zone through this gap.

After passing through the gap the gas may, depending on the configuration of the end of the guide surface, either form eddies or continue into the drying zone in approximately laminar flow. Eddies, promoted in particular by a construction such that the end of the guide surface is tilted sharply downwards, accelerate the removal of moisture particles in the immediate vicinity of the slot but reduce the efficiency of transport at greater distances from the slot. Depending on the application, by adjusting the shape of the end of the guide surface the flow of transport gas into the drying zone can be optimized.

Especially preferred is an embodiment in which the width of the gas-passage gap is between 2 and 15 mm, in particular between 5 and 10 mm. In combination with a sharp angle of incidence of the transport-gas current onto the separated moisture component, or onto the surface of the substance to be dried, such a narrow gas-passage gap particularly enhances the knife-like action. The separated moisture particles are thus removed from the surface of the substance to be dried. In particular, the transport gas forms a partition layer, flowing either in the conveyor direction or the opposite direction over the entire length of the drying zone, between the substance to be dried and moisture particles that have already separated therefrom. In a particular embodiment, therefore, as viewed from the surface of the substance to be dried at least in the vicinity of the gas-passage gap, the moisture particles are less densely distributed close to the substance to be dried and at greater distances, whether in the transport gas current or on the other side of it, become more densely distributed. In any case the knife-like action results in a higher net emergence rate of moisture particles from the substance to be dried, i.e. it prevents appreciable diffusion of the moisture particles back into the substance. The abovementioned substantive features of the apparatus in accordance with the invention are expressly claimed as essential to the invention also for embodiments of the method in accordance with the invention.

In a preferred embodiment of the apparatus, the radiation source is an incandescent bulb, in particular a halogen incandescent bulb. Halogen bulbs can be purchased at favourable prices. Their emission temperature can be made suitable for various applications by adjusting the filament current. It is also favourable to provide reflectors at or in the region of the bulb, so that as much as possible of the emitted radiation enters the drying zone. By suitable selection of the shape and disposition of the reflectors, the spatial distribution of the radiation flux over the drying zone can also be adjusted.

Preferably a reflector is provided to reflect radiation that is not absorbed and passes through the carrier material, this reflector being disposed on the side of the conveyor away from the radiation source. In particular, a water-based cooling system is provided at this reflector.

In order to control the temperature conditions in the drying zone and the area beyond this zone in the conveyor direction, the apparatus preferably comprises a control circuit to regulate the temperature of the substance to be dried and/or the temperature of the separated moisture component and/or the temperature of the carrier material. The control circuit comprises a pyrometer to measure the temperature to be regulated, an adjustable current source that powers the incandescent bulb, and a current regulator that adjusts the current source according to the temperature value reported by the pyrometer so as to alter the current supply to the bulb appropriately.

Alternatively or in addition to the combination of adjustable current source and current regulator, the apparatus comprises a distance adjuster to vary the distance separating the radiation source from the conveyor path of the carrier material and a distance regulator, which actuates the distance adjuster according to the temperature value reported by the pyrometer so as to alter the distance of the radiation source appropriately.

BRIEF DESCRIPTION OF THE DRAWINGS

In the following the invention is explained with reference to the example shown in the drawing. However, it is not limited to the exemplary embodiments shown here. The individual figures in the drawing are as follows.

DETAILED DESCRIPTION

Figure 1:
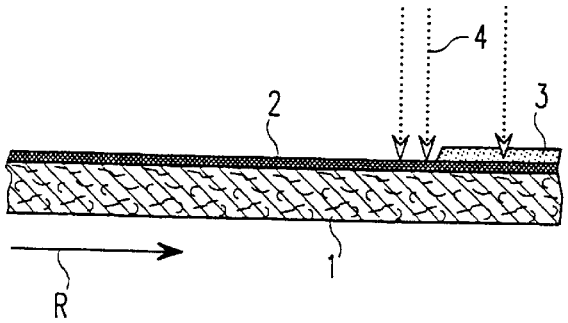
FIG. 1 shows a cross section through a carrier material that bears on its upper surface a substance to be dried.

The carrier material shown in FIG. 1 consists of paper 1 and bears on its surface a layer of moist printing ink 2. The paper 1, in the representation shown here, is being conveyed towards the right, as indicated by an arrow pointing in the conveyor direction R. Infrared radiation 4 incident upon the ink 2 is partly absorbed by the solvent, water, which constitutes a large proportion of the ink 2, e.g. 90%. Hence within the zone of incidence of the infrared radiation 4 or beyond it in the conveyor direction, there forms a thin boundary layer of water vapour 3 composed of the particles expelled from the printing ink 2. The water vapour 3 prevents further drying of the ink, as indicated schematically by the downward-pointing arrow on the right. At least two processes play a role here: the dynamic equilibrium between the water particles that enter the ink 2 and those that emerge from it, and the absorption of radiation in the water-vapour layer.

Figure 2:
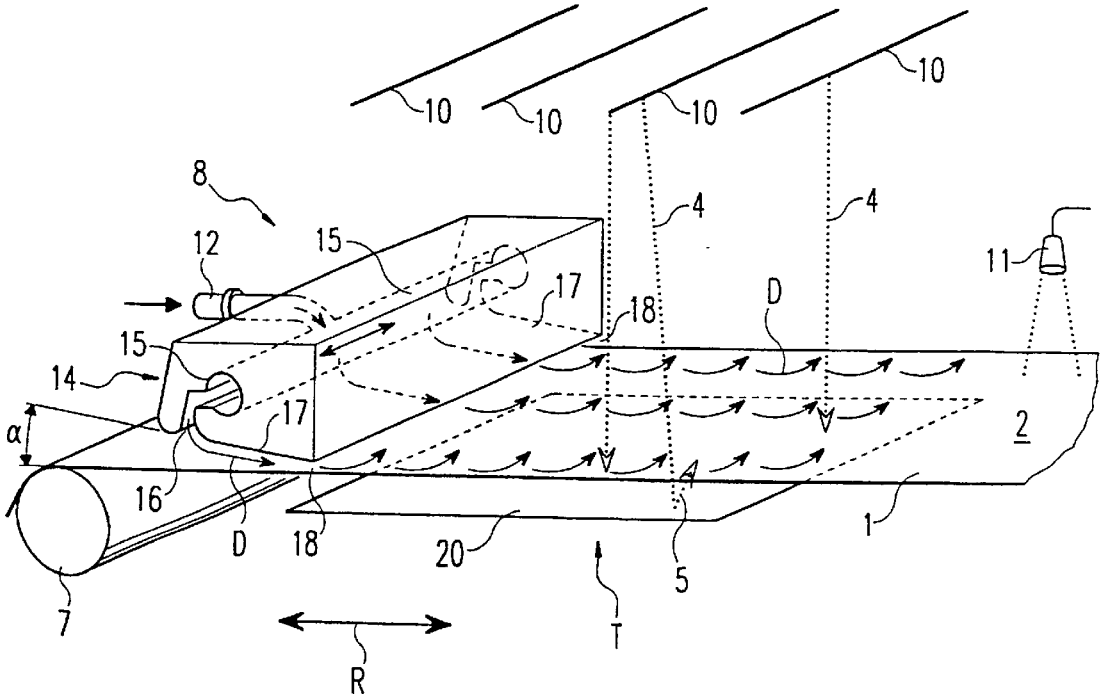
FIG. 2 shows in perspective an exemplary embodiment of the drying apparatus in accordance with the invention.

FIG. 2 shows an apparatus 8 in accordance with the invention for drying moist, water-containing printing ink 2 on the surface of a rapidly conveyed paper strip 1, in particular a printed strip of newsprint. The paper strip 1 is conveyed at a velocity of about 15 m/s. As can be seen from the double-headed arrow indicating the conveyor direction R, the paper can be conveyed either from right to left or from left to right, although during any given drying process the paper strip moves in only one direction. In the following description, it is assumed that the paper shown in FIG. 2 is being conveyed from left to right. The disposition of the compressed-air conduit 14 would, however, be the same for the case in which the paper is conveyed from right to left. The only difference from the arrangement shown in FIG. 2 would be that a pyrometer 11 (the function of which is described below) would be disposed beyond the compressed-air conduit 14 in the conveyor direction, i.e. on the left in the figure.

Along the conveyor path of the paper strip 1 is a drying zone T, within which radiation emitted by halogen line-sources 10 is incident upon the printing ink 2; the highest-energy component of this radiation is substantially infrared radiation 4. In particular, between the halogen line-sources 10 and the substance to be dried a spectral filter (not shown) can be disposed.

A certain amount of the infrared radiation 4, depending on the absorptance of the moisture component in the printing ink 2 and on the absorptance of the paper strip 1, is not absorbed but rather passes through the paper strip 1 and strikes an infrared reflector 20 positioned below the paper strip 1. As indicated by an arrow, the infrared reflector 20 reflects the infrared radiation that strikes it in such a way that this reflected radiation 5 is sent back onto the paper strip 1. Some of the reflected radiation 5 reaches the substance 2 that is to be dried and is absorbed there, mainly by the aqueous components of the printing ink 2.

Through a compressed-air inlet 12 attached to the compressed-air conduit 14 compressed air is fed into a distributor pipe 15 that extends over the entire width of the conveyor path of the paper strip 1. The distributor pipe 15 is shown cut open at its front end, to make its profile visible. In fact, however, the distributor pipe 15 is closed at both ends, so that the air emerges through an outlet opening 16 that extends across the entire width of the conveyor path. On its way to the opening the compressed air at first moves in a direction opposite to the conveyor direction and then turns at approximately a right angle, passing through a transverse conduit section towards the paper strip 1. Contiguous with the transverse conduit section is a guide surface 17, which likewise extends across the entire width of the conveyor path. The air flows along the guide surface 17 and through a passage gap 18 into the drying zone T. The guide surface 17 and the paper strip 1 define a space that becomes gradually narrower in the direction of air flow, through which the compressed air passes. The guide surface 17 and the paper strip 1, which is conveyed from the deflecting roller 7 in a straight direction, enclose an angle $\alpha$ of about 10°. At the passage gap 18, which extends across the entire width of the conveyor path, the guide surface and paper strip are separated by about 7 mm. The air supplied through the compressed-air conduit 14 flows through the passage gap 18, into the drying zone T, with a velocity of about 35 m/s. Distributed over the entire drying zone T, water-vapour particles that have been expelled from the ink 2 by the infrared radiation 4 are transported away by the air current D. The flow paths of the air current D are indicated in FIG. 2 by many slightly upward-curving arrows.

A pyrometer 11 is directed towards one place in the conveyor path of the paper strip 1, situated beyond the drying zone T in the conveyor direction. By a radiation measurement the pyrometer 11 thus monitors the temperature of the surface layer carried by the paper strip 11, which consists substantially of already dried printing ink 2. The temperature value so measured is sent to a controller (not shown). The controller, for instance a PI or a PID controller, responds by sending out a control signal that can be received by two final control elements. A current modulator, which mediates short-term, rapid adjustment of the electric current to the filament of the halogen line-source 10, is triggered by the controller when a usually slight, rapid-response adjustment of the radiation flow density is required. If the temperature measured by the pyrometer 11 reaches the limit of a predetermined range within which the current modulator can operate, a distance adjustor is triggered in order to alter the distance of the radiation source 10 from the conveyor path of the paper strip 1. Although it is slow in comparison with the action of the current modulator, the adjustment of distance expands the overall control range by making the relatively narrow current-control range usable over a large range of temperatures or radiation flux densities. Hence the short-term alteration of the flux density of the radiation incident in the drying zone, and thus a regulation of the temperature, can be effected with little inertia over the entire range within which control by distance adjustment operates.

Preferably air with low residual humidity is sent into the compressed-air inlet 12; it is then cooled by the subsequent expansion in the distributor pipe and/or after flowing out of the distributor pipe 15. Thus dry, cold air is introduced into the drying zone T. This has the advantage that on one hand the removal of the moisture component from the drying zone T is improved, while on the other hand the temperature of the printing ink 2 and hence also the temperature of the paper strip 1 can be kept low. In particular, it is possible to keep the temperature of the paper strip 1 below 50° C., when the paper strip 1 is conveyed at a velocity of about 5 m/s and the air-flow velocity at the passage slot 18 is about 35 m/s. The drying apparatus in accordance with the invention can in particular also be used in equipment for producing page-size printed matter such as prospectuses, magazines or pages of drawings, when such equipment comprises a suitable conveyor device to convey the carrier material to be printed.

Furthermore, the method in accordance with the invention and the apparatus in accordance with the invention can advantageously be employed in printing equipment that produces individualized print products such as consecutively numbered bus or train tickets, or sequential sheets or sections of paper strip bearing individual bar codes. Such installations often employ ink-jet printers, in particular with a print resolution of 240 dpi or better. With the apparatus and the method in accordance with the invention it is possible, for example, to produce 54,000 printed DIN A4 sheets per hour.

What is claimed is:

1. Method of drying a substance on a carrier material that is rapidly conveyed in a conveyor direction, wherein in a drying zone by means of incident electromagnetic radiation from a source thereof, a moisture component is separated from the substance to be dried, the separated moisture component is transported away from the drying zone by means of a transport gas current, and the transport gas current after leaving the drying zone flows to the source of the electromagnetic radiation for cooling thereof.

2. Method of drying a substance on a carrier material that is rapidly conveyed in a conveyor direction, wherein in a drying zone by means of a source of incident electromagnetic radiation having a radiation flux density and spatially separated from the substance, a moisture component is separated from the substance to be dried, the separated moisture component is transported away from the drying zone by means of a transport gas current, and the temperature of the dried substance and/or the temperature of the separated moisture component and/or the temperature of the carrier material is controlled by adjusting the radiation flux density of the electromagnetic radiation incident in the drying zone.

3. Method according to claim 2, wherein the temperature to be controlled is measured by means of a pyrometer.

4. Method according to claim 2, wherein the electromagnetic radiation is supplied by an electrical incandescent bulb, and wherein to adjust the radiation flux density the current supply to the filament of the incandescent bulb is adjusted.

5. Method according to claim 2, wherein to adjust the radiation flux density the spatial distance of the radiation source from the drying zone is adjusted.

6. Method according to claim 2, wherein the electromagnetic radiation that is not absorbed but rather passes through the substance to be dried is reflected back onto said substance.

7. Method according to claim 2, wherein the transport gas current within a region disposed transverse to the conveyor direction flows into the drying zone from a direction that encloses an angle of about 60 to 90° with the perpendicular to the surface of the substance to be dried.

8. Method according to claim 2, wherein the temperature of the transport gas current, at least before encountering the moisture component, is lower than the temperature of the substance to be dried.

9. Method according to claim 2, wherein the transport gas current is formed by expanded compressed air.

10. Method according to claim 2, wherein the incident electromagnetic radiation has a spectral intensity maximum in the near infrared, in the wavelength range from 0.8 to 2.0 $\mu$m.

11. Method of drying printing ink on paper that is rapidly conveyed in a conveyor direction, wherein, in a drying zone by means of incident electromagnetic radiation, a moisture component is separated from the printing ink to be dried, the separated moisture component is transported away from the drying zone by means of a transport gas current, and the paper is conveyed with a conveyor velocity between about 10 and 20 m/s.

12. Method of drying printing ink on thermoprinting paper that is rapidly conveyed in a conveyor direction, wherein, in a drying zone by means of incident electromagnetic radiation, a moisture component is separated from the printing ink to be dried, the separated moisture component is transported away from the drying zone by means of a transport gas current, and the thermoprinting paper is conveyed with a conveyor velocity between about 2 and 10 m/s.

13. Method of drying printing ink on thermoprinting paper that is rapidly conveyed in a conveyor direction, wherein, in a drying zone by means of incident electromagnetic radiation, a moisture component is separated from the printing ink to be dried, the separated moisture component is transported away from the drying zone by means of a transport gas current, and the temperature of the thermoprinting paper is adjusted and/or regulated to a value below about 70° C.

14. Apparatus for drying a substance on a carrier material that is rapidly conveyed along a conveyor path, comprising, a radiation source to generate electromagnetic radiation, wherein the radiation source is so disposed that at least part of the electromagnetic radiation is incident on the substance to be dried within a drying zone on the conveyor path of the carrier material, in order to separate a moisture component from the substance to be dried, a transport-gas inlet through which transport gas is introduced, a transport-gas conduit that at least in parts extends transverse to the conveyor direction, which is so constructed and disposed that transport gas introduced through the transport-gas inlet is guided into the drying zone and strikes the substance to be dried so as to transport the separated moisture component away from the substance to be dried, and the transport-gas conduit comprises a guide surface that extends approximately along the conveyor path of the substance to be dried, is separated from the conveyor path by a distance that gradually becomes smaller in the gas-flow direction, and ends at a gas-passage gap that is defined by the guide surface and the substance to be dried.

15. Apparatus according to claim 14, wherein the separation between the guide surface and the substance to be dried at the gas-passage gap is between about 2 and 15 mm.

16. Apparatus according to claim 14, wherein the radiation source is a halogen incandescent bulb.

17. Apparatus for drying a substance on a carrier material that is rapidly conveyed along a conveyor path, comprising, a radiation source, including an electrical incandescent bulb having a filament and current coupled to the filament to generate electromagnetic radiation, wherein the electrical incandescent bulb is so disposed that at least part of the electromagnetic radiation is incident on the substance to be dried within a drying zone on the conveyor path of the carrier material, in order to separate a moisture component, from the substance to be dried, a transport-gas inlet through which transport gas is introduced, a transport-gas conduit that at least in parts extends transverse to the conveyor direction, which is so constructed and disposed that transport gas introduced through the transport-gas inlet is guided into the drying zone and strikes the substance to be dried, so as to transport the separated moisture component away from the substance to be dried, and a control circuit to regulate the temperature of the substance to be dried and/or the temperature of the separated moisture component and/or the temperature of the carrier material, said control circuit comprising, a pyrometer to measure the temperature to be regulated, a final control element to adjust the current to the filament of the incandescent bulb, and a current controller that actuates the final control element according to the temperature measured by the pyrometer, in order to adjust the filament current.

18. Apparatus according to claim 17, wherein the transport-gas is compressed-air and wherein the transport-gas conduit comprises a compressed-air distributor, including a distributor pipe, to distribute the compressed air substantially over the entire conveyor path.

19. Apparatus according to claim 18, wherein the compressed-air distributor has an outlet opening, for the compressed air to be guided into the drying zone, said outlet opening extending substantially over the entire width of the conveyor path.

20. Apparatus for drying a substance on a carrier material that is rapidly conveyed along a conveyor path, comprising, a radiation source to generate electromagnetic radiation, wherein the radiation source is spatially separated from the conveyor path of the carrier material and so disposed that at least part of the electromagnetic radiation is incident on the substance to be dried within a drying zone on the conveyor path of the carrier material, in order to separate a moisture component from the substance to be dried, a transport-gas inlet through which transport gas is introduced, a transport-gas conduit that at least in parts extends transverse to the conveyor direction, which is so constructed and disposed that transport gas introduced through the transport-gas inlet is guided into the drying zone and strikes the substance to be dried so as to transport the separated moisture component away from the substance to be dried, and a control circuit to regulate the temperature of the substance to be dried and/or the temperature of the separated moisture component and/or the temperature of the carrier material, said control circuit comprising, a pyrometer to measure the temperature to be regulated, a final control element to adjust the spatial distance separating the radiation source from the conveyor path of the carrier material, and a distance controller that actuates the final control element according to the temperature measured by the pyrometer, in order to adjust the spatial distance of the radiation source.

21. Apparatus according to claim 20, including a reflector to reflect radiation that passes through the carrier material without being absorbed, wherein the reflector is disposed on the side of the conveyor path opposite the radiation source.

* * * * *